US006149024A

United States Patent [19]

Deemer et al.

[11] Patent Number: 6,149,024

[45] **Date of Patent: *Nov. 21, 2000**

[54] PLASTIC BOTTLE HAVING ENHANCED SCULPTURED SURFACE APPEARANCE

[75] Inventors: David A. Deemer; Charles M. Brandt, both of Douglasville, Ga.

[73] Assignee: Constar, Inc., Philadelphia, Pa.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/018,777

[22] Filed: Feb. 4, 1998

Related U.S. Application Data

[63] Continuation of application No. 08/599,109, Feb. 9, 1996, Pat. No. 5,735,421, which is a continuation of application No. 08/482,805, Jun. 7, 1995, which is a continuation of application No. 08/236,365, Apr. 29, 1994.

[51] Int. Cl.[7] ..... B65D 90/12

[52] U.S. Cl. ..... 215/382; 215/375; 220/675; 220/669

[58] Field of Search ..... 220/606, 608, 220/669, 675, 673; 215/382, 375; D9/548, 559, 550, 556, 375

[56] References Cited

U.S. PATENT DOCUMENTS

| | | | |
|---|---|---|---|
| 3,871,541 | 3/1975 | Adomaitis | 215/381 |
| 3,944,124 | 3/1976 | Hexel | 229/1.5 B |
| 4,749,032 | 6/1988 | Sugiura et al. | 215/381 |
| 5,054,632 | 10/1991 | Alberghini et al. | 215/381 |
| 5,067,622 | 11/1991 | Garver et al. | 215/381 |
| 5,593,056 | 1/1997 | Mero et al. | 215/382 |
| 5,735,421 | 4/1998 | Demer et al. | 215/382 |
| 5,740,934 | 4/1998 | Brady | 215/382 X |

FOREIGN PATENT DOCUMENTS

| | | | |
|---|---|---|---|
| 0 423 406 A1 | 10/1989 | European Pat. Off. | B65D 1/02 |
| 0 502 391 A3 | 2/1992 | European Pat. Off. | B25C 49/64 |

*Primary Examiner*—Stephen P. Garbe
*Assistant Examiner*—Tri M. Mai
*Attorney, Agent, or Firm*—Woodcock Washburn Kurtz Mackiewicz & Norris LLP

[57] ABSTRACT

A plastic bottle having a substantially uniform side wall thickness yet having a sculptured appearance is formed generally symmetrically about a vertical axis. The bottle includes a base portion, a side wall portion extending upward from a lower margin united to the base portion to an upper margin, a shoulder portion extending from the upper margin of the side wall portion to a neck portion, and a finish portion united to the neck portion and adapted to receive a closure. At least one of the side wall and shoulder portions includes a plurality of generally vertical ribs spaced uniformly around a circumference of the bottle, each generally vertical rib having an upper and lower end and, in cross-section, a central portion situated at a first radius from the bottle axis and a pair of generally symmetric side portions leading to the bottle surface at a second radius from the bottle axis, at least one set of the upper and lower ends of the ribs terminating at a common height on the container. Only one of the upper and lower ends of the ribs on each portion of the bottle is joined together by a set of arcuate rib segments forming a scalloped line around the circumference of the bottle giving the appearance of a substantial variation in side wall thickness.

11 Claims, 5 Drawing Sheets

PLASTIC BOTTLE HAVING ENHANCED SCULPTURED SURFACE APPEARANCE

This is a continuation application of U.S. Ser. No. 08/599,109 filed Feb. 9, 1996, now U.S. Pat. No. 5,735,421, which is continuation of U.S. Ser. No. 08/482,805 filed Jun. 7, 1995, now abandoned, which is a continuation of U.S. Ser. No. 08/236,365 filed Apr. 29, 1994.

BACKGROUND OF THE INVENTION

The present invention is directed to plastic containers such as bottles having side walls of substantially uniform thickness having decorative features intended to give the appearance of non-uniform thickness. The present invention is particularly directed to such bottles which are intended to contain liquids under elevated pressure such as carbonated beverages.

Historically many glass bottles intended to contain a specific brand of a liquid product, for example a specific brand of a carbonated beverage, were specifically designed to include patterns generally obtained by variations in wall thickness. The specific designs often came to have trademark significance with respect to the particular liquid product sold in such a bottle. As the glass containers were replaced with plastic containers, particularly single use containers, cost constraints required that the plastic container side wall thickness be maintained as thin as possible. The substantial variations in side wall thickness used in glass to generate the designed patterns proved to be economically impossible in plastic. While many products resorted to generic bottles devoid of surface features thus having no trademark significance, the demand for bottles having such features continued but was largely unsatisfied.

Some attempts were made to create bottles having such surface features by simply molding a container having a uniform side wall thickness and an outer surface matching the outer surface of the previously used glass container. When such bottles were used for liquids at non-elevated pressures, the bottles generally retained the intended appearance. However, when such bottles were used for liquids at super atmospheric pressures, such as carbonated beverages, the internal pressure within the bottle substantially obliterated the surface features unless the sidewall thickness of the bottle was significantly increased which made the bottle economically unsatisfactory. As a result, little if any trademark significance was attributed by the purchasing public to the current shape of the bottle, and historically important trademarks were decreasingly used. The possible loss through disuse of such trademarks was unacceptable and demand remained for a low cost bottle having a satisfactory reproduction of the old glass bottle designs.

SUMMARY OF THE INVENTION

A plastic bottle in accordance with the present invention has a substantially uniform side wall thickness yet has a sculptured surface appearance which is discernable from a distance of five to ten meters depending upon ambient lighting conditions. The bottle generally comprises a base portion for supporting the bottle on an underlying substrate, a side wall portion extending upward from a lower margin united to the base portion to an upper margin, a shoulder portion extending from the upper margin of the side wall portion to a neck portion, and a finish portion united to the neck portion and adapted to receive a closure. At least one of the side wall and shoulder portions includes a plurality of generally vertical ribs spaced uniformly around a circumference of the bottle, each generally vertical rib having an upper and lower end, at least one set of the upper and lower ends of the ribs terminating at a common height on the container. The term generally vertical is intended to encompass any rib having a length in the axial direction of the bottle which exceeds its length in the circumferential direction. At least one of the upper and lower ends of the circumferentially spaced ribs is joined together by a set of rib segments forming a line around the circumference of the bottle giving the bottle an appearance of a substantial variation in side wall thickness in the form of a mock flute or other sculptured surface feature.

Each of the plurality of generally vertical ribs comprises in cross-section a central portion situated at a first radius from the bottle axis and a pair of generally symmetric side portions leading to the bottle surface at a second radius from the bottle axis. Preferably, the first radius is greater than the second radius thus producing a protruding rib. Although a satisfactory bottle can be formed with an indented rib on a bottle with outwardly curving surfaces or cylindrical surfaces, the use of an indented rib on an inwardly curved surface tends to buckle when the bottle is pressurized. This buckling detracts from or destroys the highlight effect sought by this invention and can lead to cracking problems.

Preferably, each of the plurality of generally vertical ribs has a width of about two to four times the height of the rib above the remaining surface of the bottle which is about two to four times the difference between said first and second radius from the axis of the bottle. Each of the generally symmetric side portions of each of the plurality of generally vertical ribs includes in cross-section a curved surface portion having a radius less than or equal to the difference between said first and second radius, the radius of the curved surface portion being about 150% to 200% of the side wall thickness which is small enough as to retain the required rib definition even when the bottle is internally pressurized.

One feature of the present invention is that the bottle side wall portion is generally symmetric about the bottle axis, the ribs giving the bottle an appearance of a substantial variation in side wall thickness constituting the only substantial variation from the axial symmetry. The appearance of substantial variation in side wall thickness is achieved through the use of a set of rib segments forming a line around the circumference of the bottle joining the common ends of the vertical ribs. Preferably, the rib segments form a scalloped line around the circumference of the bottle to provide the illusion of a complex sculptured surface. The rib segments include at least one curved side to enhance the sculptured surface illusion. Different illusions of thickness and shape can be created by including arches which can be bowed in different directions or flattened to define highlight lines.

Other features of the present invention will become apparent to those skilled in the art upon consideration of the following description of a preferred embodiment incorporating the best mode of the invention as presently perceived. The description refers to the accompanying drawings.

DESCRIPTION OF THE PREFERRED EMBODIMENT

Figure 1:
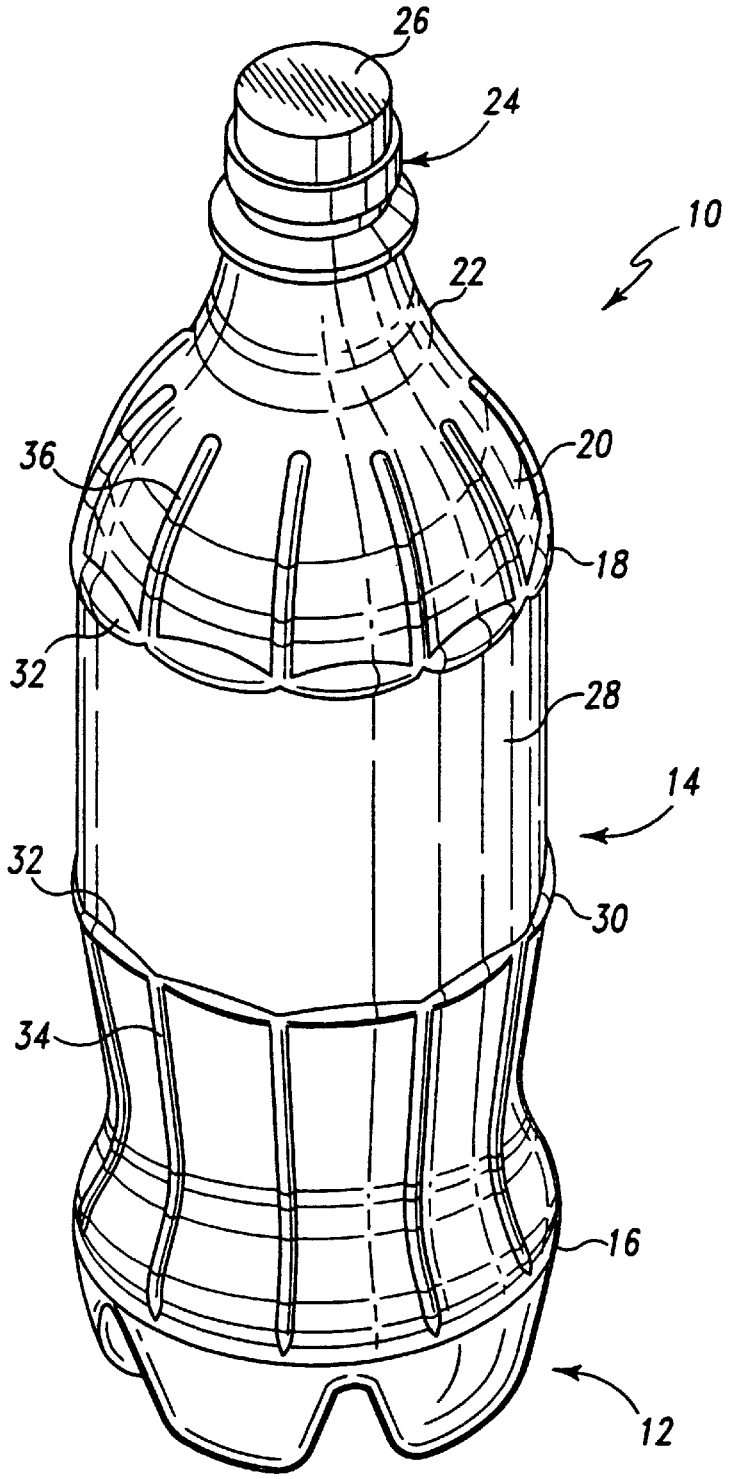
FIG. 1 is a perspective view of a bottle according to the present invention.
Figure 4:
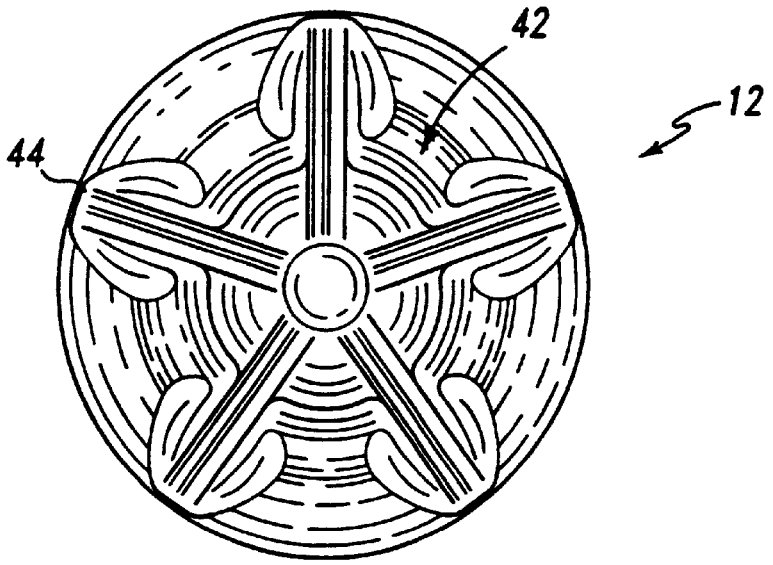
FIG. 4 is a bottom plan view of the bottle shown in FIG. 1.

A perspective view of a plastic bottle made in accordance with the present invention is shown in FIG. 1. The bottle 10 comprises a base portion 12 which is shown to be of a footed design. The preferred bottom is shown in FIG. 4 to comprise five downwardly extending feet 42 separated by arcuate segments 44 extending between the lower margin 16 of the sidewall 14 and the lower end of axis Y. While the preferred footed design is that disclosed in co-pending U.S. application Ser. No. 08/077,856, filed Jun. 16, 1993, incorporated herein by reference, other designs can be used, whether footed or so-called champagne style, to provide a base for the bottle in accordance with the present invention.

Bottle 10 also includes a side wall portion 14 which extends from a lower margin 16 which is united to base 12 to an upper margin 18 which is united to a shoulder portion 20. The shoulder portion 20 extends from the upper margin 18 of the side wall to the neck portion 22 which is situated immediately below a finish portion 24 intended to receive a closure 26.

The side wall portion 14 preferably includes a label panel 28 to which an appropriate label can be applied to identify the contents of the bottle. The label panel has an upper margin nearly coincident with the upper margin 18 of the side wall and has a lower margin 30, both margins being defined by a set of rib segments 32 joined end-to-end and forming two lines around the circumference of the bottle at the upper and lower margins of the label panel 28. As is shown most clearly in FIGS. 2 and 7, the circumferentially extending rib segments 32 include at least one curved side so the line formed defining the upper and lower margin of the label panel appears scalloped rather than linear.

Figure 2:
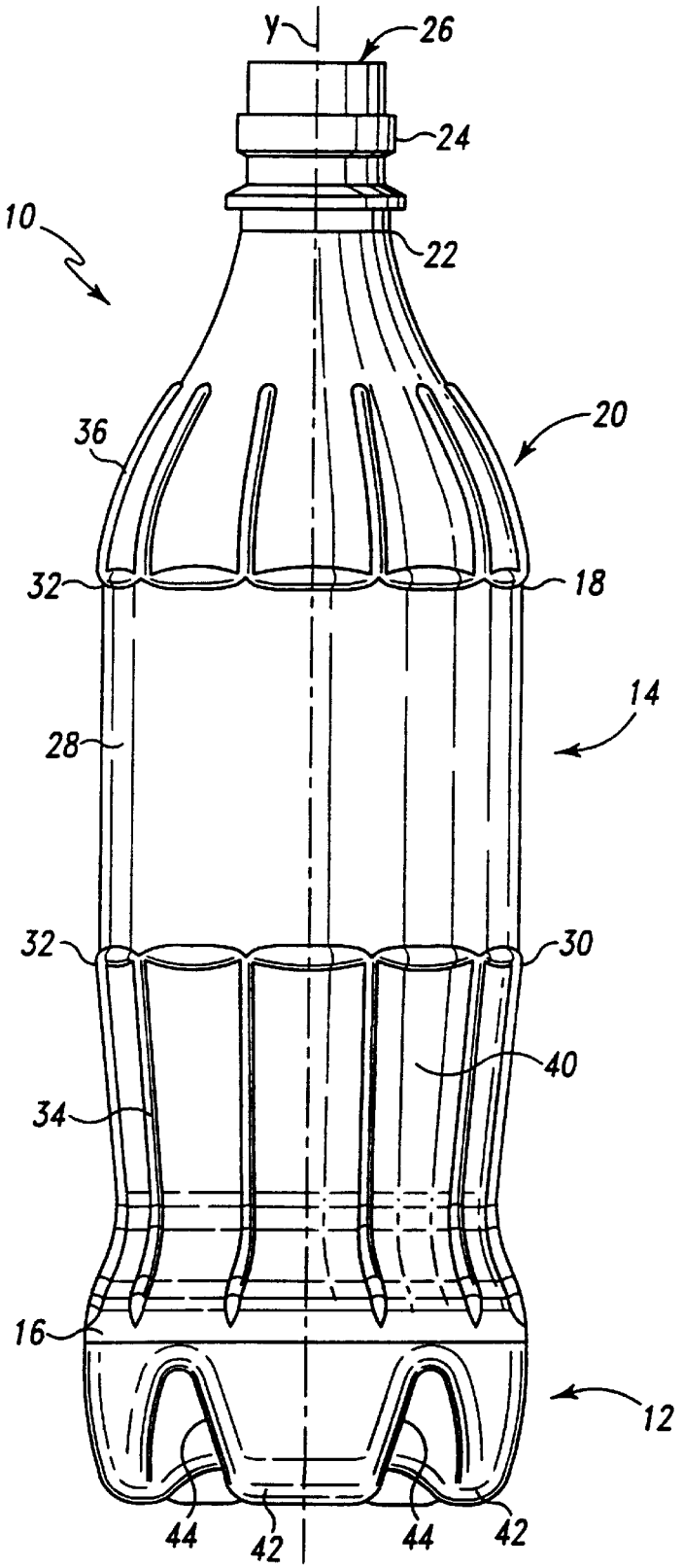
FIG. 2 is a side elevation view of the bottle shown in FIG. 1.
Figure 7A:
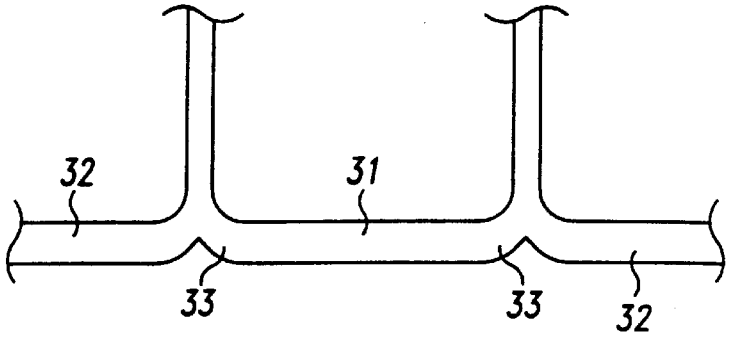
FIGS. 7A, 7B, 7C and 7D are detail elevation views of various alternative designs for the rib segments forming the scalloped line around the circumference of the bottle.
Figure 7B:
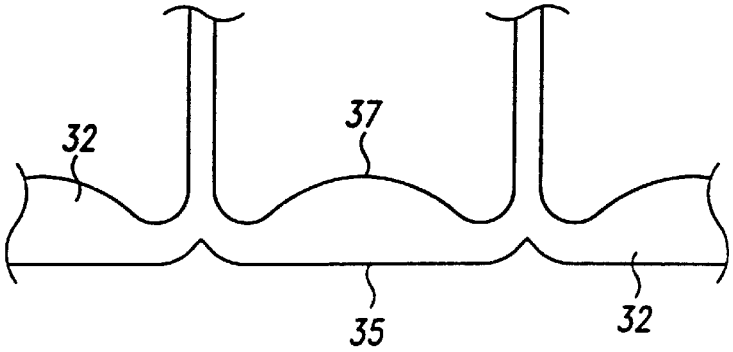
Figure 7C:
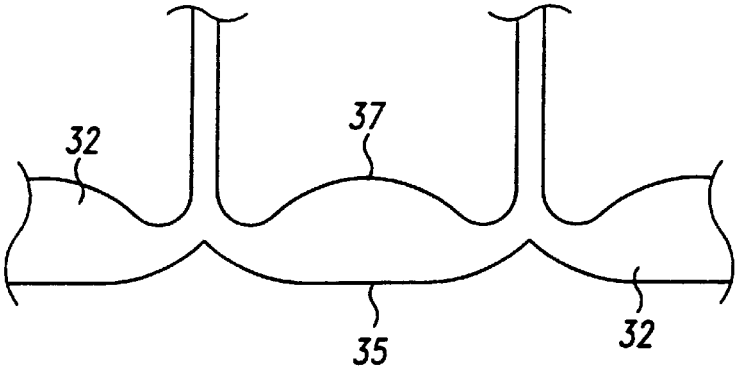
Figure 7D:
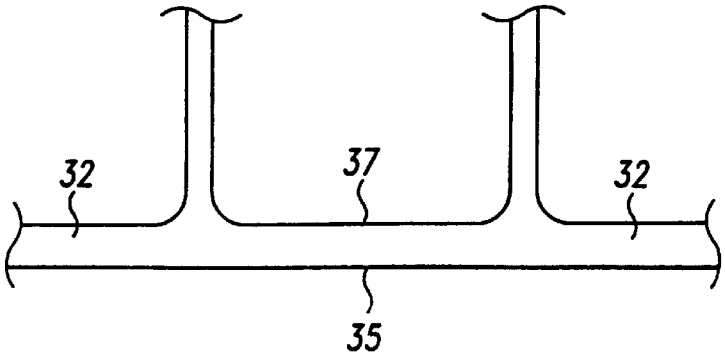

In FIG. 2, the both sides of the rib segments 32 are shown to be arched equally and in the same direction over the entire length of the rib segment. In FIG. 7A, the sides of the rib segments 32 comprise flattened arches having a linear central portion 31 and curved end portions 33. In FIG. 7B, the lower side 35 of the rib segments 32 comprises a flattened arch as in FIG. 7A, but the upper side 37 constitutes a reverse upward bow. In FIG. 7C, the upper side 37 retains the reverse upward bow as in FIG. 7B, but the lower side 35 is an arch similar to FIG. 2. Finally, in FIG. 7D, the upper side 37 is a flattened arch as in FIG. 7A while the lower side 35 is substantially linear. Other designs which include at least one curved side are possible as will be appreciated by a designer of such containers.

A lower portion of the side wall 14 and the shoulder portion 20 also includes a set of circumferentially spaced ribs 34 and 36, respectively. The upper ends of ribs 34 are joined by the rib segments 32 at the lower margin 30 of the label panel while the ribs 36 on the shoulder portion 20 of the bottle are joined at their lower ends by rib segments 32 at the margin 18. The lower ends of ribs 34 terminate near the lower margin 16 of the side wall and are not joined together as are the upper ends of ribs 34. Similarly, the upper ends of ribs 36 on the shoulder portion 20 terminate just below the neck portion 22 and are not joined together like the lower ends of ribs 36. The combined effect of ribs 34, 36 and rib segments 32 is to form a bottle appearing to have a substantial variation in thickness forming a series of flutes. It will be appreciated that the vertical flutes are merely an illustrative example of the sculptured surface appearance which can be achieved and that other sculptured surface features are possible using the ribs 36 and rib segments 32 in accordance with this disclosure.

Figure 3:
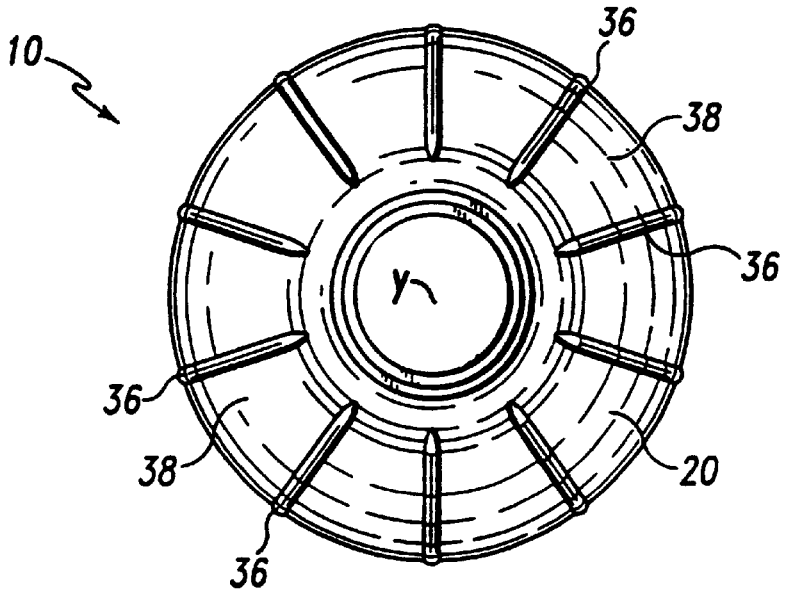
FIG. 3 is a top plan view of the bottle shown in FIG. 1.

As best shown in FIG. 3, the portions of the bottle 38 existing between the vertical ribs 36 are merely circular sections centered on the axis of symmetry of the bottle Y. That is, the segments 38 between the ribs 36 do not bulge outwardly to form a true flute or other protruding surface feature. Rather, the regions 38 between the ribs 36 taken together with the rib segments 32 have the illusion of bulging outwardly and thus form a shoulder having a mock sculptured surface above the label panel 28. In the same way, the segments 40 between the ribs 34 of the container are also circular segments symmetric about the vertical axis Y.

Figure 5A:
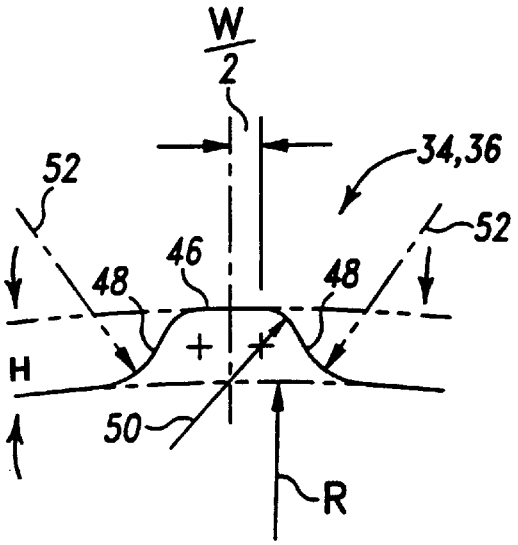
FIG. 5A is an enlarged cross-sectional view of the outer surface of a generally vertical rib on the bottle shown in FIG. 1.

The vertical ribs 34 and 36 have an exterior confirmation which is defined in cross-section by the series of curves shown in FIG. 5A. The ribs 34 and 36 each extend outwardly from the side wall or shoulder portion defined by a radius R measured from the axis Y by a height H which is generally constant along the length of the rib. A typical height H for the rib is about 25% to 50% of the width of the rib. The outside surface of the ribs 34, 36 is shown to have a planar central portion 46 having a width about equal to the height H. A pair of generally symmetric side portions 48 lead to the surface of the bottle defined by the radius R from the bottle axis Y. The side portions are shown to be defined by a pair of intersecting arcs defined by radius 50 and 52. The total width of the rib is about three or four times height H of the rib.

Figure 5B:
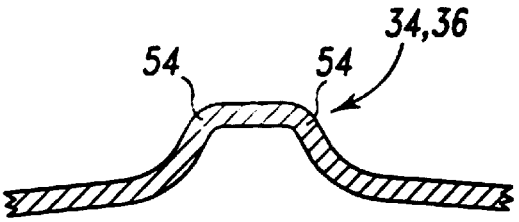
FIG. 5B is a cross-sectional view of the rib shown in FIG. 5A showing the material forming the bottle.

The physical presentation of the rib taken in cross-section is shown in FIG. 5B with the outside surface being identical to that shown in FIG. 5A and the wall thickness of the material forming the rib being shown in cross-section. Even under the pressure normally exerted by a carbonated beverage in such a bottle, the tight radius 50 defining the corner portions 54 of the rib prevents the rib from "washing out" and thus the bottle itself retains the necessary surface features to impart to the bottle a mock sculptured surface which gives the bottle the appearance of having a substantial variation in wall thickness, which variation is not present.

FIG. 6pi ashows the outside surface of a typical rib segment 32 which is used to form the circumferential lines 18 and 30 around the bottle. The base of the rib segment 32, like the ribs 34 and 36, is situated at radius R from the axis Y of the container. The peak of the rib is at a greater radius R plus Δ, where Δ is about 25% to 50% of the width of the rib. In a typical container having an average radius R of about 6 or 7 cm., the height Δ would be between about 0.5 and 2 mm. The outer surface of the rib segment is defined by the end-to-end joining of three radii 56, 58 and 60 shown to be of equal size. The actual cross-section of the bottle side wall through rib segment 32 is shown in FIG. 6B. It will be appreciated that the thickness of the material forming the bottle, typically between about 0.25 mm. and 0.5 mm. is sufficient to retain most of the rib segment form even when the container 10 is under the pressure typically exhibited by a carbonated beverage.

Although the invention has been described in detail with reference to the illustrated preferred embodiment, other variations and modifications exist within the scope and spirit of the invention as described and as defined in the following claims.

What is claimed is:

1. A plastic bottle having a sculptured appearance, the bottle comprising a base portion for supporting the bottle on an underlying substrate, a side wall portion extending upward from the base portion, a shoulder portion extending upward from the side wall portion to a neck portion, and a finish portion united to the neck portion and adapted to receive a closure, at least one of the side wall and shoulder portions comprising circumferentially-extending inner and outer surfaces defining a thickness thereof therebetween and a plurality of circumferentially spaced generally outwardly protruding ribs, each of said ribs formed by outward projections formed in the inner and outer surfaces, each of the outward projections in the inner surface aligned with its respective outward projection in the outer surface so that the thickness remains substantially circumferentially uniform, the portions of the bottle between each of the ribs having an outwardly-convex transverse cross section, each of the ribs being joined together by a set of circumferentially extending rib segments giving the bottle an appearance of substantial variation in thickness.

2. The bottle of claim 1 wherein the base portion comprises a plurality of downwardly projecting feet, each foot having a lowermost portion for contacting the underlying substrate, each foot being separated from circumferentially adjacent feet by a arcuate portion joining the lower margin to a vertical axis of the bottle.

3. The bottle of claim 1 wherein the side wall portion includes a generally cylindrical surface having an upper and a lower edge, at least one of the upper and lower edges being defined by said set of rib segments forming a line around the circumference of the bottle giving the bottle the appearance of a substantial variation in side wall thickness.

4. The bottle of claim 1 wherein the side wall portion includes a generally cylindrical surface having an upper and a lower edge, and wherein the rib segments form a scalloped line defining the upper edge of said generally cylindrical surface of the side wall portion.

5. The bottle of claim 4 wherein the side wall portion further includes a second plurality of ribs spaced around a circumference of the side wall portion of the bottle, the second plurality of ribs being joined together by a second set of arcuate rib segments forming a second scalloped line defining the lower edge of said generally cylindrical surface of the side wall portion.

6. The bottle of claim 1 wherein said bottle is defined about a vertical axis and said side wall comprises a bottle surface, and each of the plurality of ribs comprises in cross-section a central portion situated at a first radius from the bottle axis and a pair of generally symmetric side portions leading to the bottle surface at a second radius from the bottle axis.

7. The bottle of claim 6 wherein said first radius is greater than said second radius.

8. The bottle of claim 6 wherein each of the plurality of ribs has a width of about two to four times the difference between said first and second radius.

9. The bottle of claim 6 wherein each of the generally symmetric side portions of each of the plurality of ribs includes in cross-section a curved surface portion having a radius at most equal to the difference between said first and second radius.

10. A plastic bottle having a sculptured appearance, the bottle comprising a base portion for supporting the bottle on an underlying substrate, a side wall portion, a lower intermediate portion extending upward from the base portion to the sidewall portion, a shoulder portion extending upward from the sidewall portion to a neck portion, and a finish portion united to the neck portion and adapted to receive a closure, at least one of the lower intermediate and shoulder portions comprising circumferentially-extending inner and outer surfaces defining a thickness thereof therebetween and a plurality of circumferentially spaced generally outwardly protruding ribs, each of said ribs formed by outward projections formed in the inner and outer surfaces each of the outward projections in the inner surface aligned with its respective outward projection in the outer surface so that the thickness remains substantially circumferentially uniform, the portions of the bottle between each of the ribs having an outwardly-convex transverse cross section each of the ribs being joined together by a set of circumferentially extending rib segments giving the bottle an appearance of substantial variation in thickness.

11. A plastic bottle having a sculptured appearance, the bottle comprising a base portion for supporting the bottle on an underlying substrate, a side wall portion, a lower intermediate portion extending upward from the base portion to the sidewall portion, a shoulder portion extending upward from the side wall portion to a neck portion, and a finish portion united to the neck portion and adapted to receive a closure, both of the lower intermediate and shoulder portions comprising circumferentially-extending inner and outer surfaces defining a thickness thereof therebetween and a plurality of circumferentially spaced generally outwardly protruding ribs, each of said ribs formed by outward projections formed in the inner and outer surfaces, each of the outward projections in the inner surface aligned with its respective outward projection in the outer surface so that the thickness remains substantially circumferentially uniform, the portions of the bottle between each of the ribs having an outwardly-convex transverse cross section, each of the ribs being joined together by a set of circumferentially extending rib segments giving the bottle an appearance of a substantial variation in thickness.

* * * * *

UNITED STATES PATENT AND TRADEMARK OFFICE

CERTIFICATE OF CORRECTION

Figure 6A:
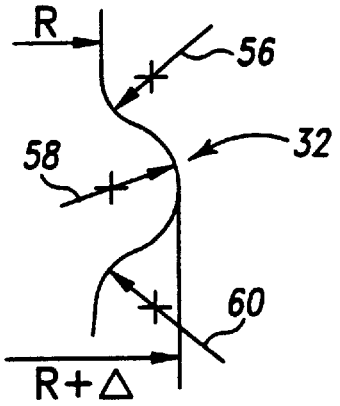
FIG. 6A is an enlarged cross-sectional view of the outer surface of a circumferential rib segment on the bottle shown in FIG. 1.
Figure 6B:
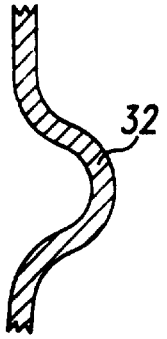
FIG. 6B is a cross-sectional view of the rib segment shown in FIG. 6A showing the material forming the bottle.

PATENT NO. : 6,149,024
DATED : November 21, 2000
INVENTOR(S) : David A. Deemer and Charles M. Brandt It is certified that error appears in the above-identified patent and that said Letters Patent is hereby corrected as shown below:

Title page,
Item [56], References Cited, U.S. PATENT DOCUMENTS, delete "5,735,421 4/1998 Demer et al. 215/382" and insert -- 5,735,421 4/1998 Deemer et al. 215/382 --;

Column 3,
Line 8, delete "are detail elevation" and insert -- are detailed elevation --;
Line 46, delete "the both sides" and insert -- both sides --;

Column 4,
Line 49, delete "Figure 6pi ashows" and insert -- Figure 6A shows --;

Column 5,
Line 29, delete "a arcuate" and insert -- an arcuate --;

Column 6,
Line 23, delete "surfaces each" and insert -- surfaces, each --;
Line 28, delete "section each" and insert -- section, each --.

Signed and Sealed this

Second Day of March, 2004

JON W. DUDAS
*Acting Director of the United States Patent and Trademark Office*